US011566377B2

(12) United States Patent
Vaulot et al.

(10) Patent No.: US 11,566,377 B2
(45) Date of Patent: Jan. 31, 2023

(54) BINDER COMPOSITION BASED ON PLANT FIBERS AND MINERAL FILLERS, PREPARATION AND USE THEREOF

(71) Applicants: CENTRE TECHNIQUE DE L'INDUSTRIE DES PAPIERS, CARTONS ET CELLULOSES, Gieres (FR); KADANT LAMORT, Vitry-le-Francois (FR)

(72) Inventors: Frédéric Vaulot, Prunay (FR); Alain Lascar, Saint Maurice (FR); Bruno Carre, La Combe de Lancey (FR); Alain Cochaux, Bernin (FR); Laurence Leroy, Champagnier (FR)

(73) Assignee: CENTRE TECHNIQUE DE L'INDUSTRIE DES PAPIERS, CARTONS ET CELLULOSES, Vitry-le-Francois (FR)

( * ) Notice: Subject to any disclaimer, the term of this patent is extended or adjusted under 35 U.S.C. 154(b) by 139 days.

(21) Appl. No.: 17/227,096

(22) Filed: Apr. 9, 2021

(65) Prior Publication Data

US 2021/0230803 A1 Jul. 29, 2021

Related U.S. Application Data

(63) Continuation of application No. 16/463,964, filed as application No. PCT/EP2017/080831 on Nov. 29, 2017, now Pat. No. 10,975,523.

(30) Foreign Application Priority Data

Nov. 29, 2016 (FR) ..... 1661626

(51) Int. Cl.

| | |
|---|---|
| ***D21H 11/18*** | (2006.01) |
| ***D21C 5/00*** | (2006.01) |
| ***D21C 9/00*** | (2006.01) |
| ***D21H 17/68*** | (2006.01) |
| ***D21H 17/00*** | (2006.01) |

(52) U.S. Cl.

CPC ..... *D21H 11/18* (2013.01); *D21C 5/005* (2013.01); *D21C 9/007* (2013.01); *D21H 17/68* (2013.01); *D21H 17/74* (2013.01)

(58) Field of Classification Search

CPC ..... D21H 11/18; D21H 17/74; D21H 17/68; D21C 5/005; D21C 5/00; D21C 9/007; D21C 9/00

USPC ..... 162/9

See application file for complete search history.

(56) References Cited

U.S. PATENT DOCUMENTS

| | | | | |
|---|---|---|---|---|
| 2,949,397 | A * | 8/1960 | Gilman | D21C 3/006 162/178 |
| 2011/0259537 | A1* | 10/2011 | Husband | D21H 11/20 162/26 |
| 2012/0012031 | A1* | 1/2012 | Husband | D21H 19/38 106/204.3 |
| 2012/0094953 | A1* | 4/2012 | Gane | D21C 9/007 106/805 |
| 2012/0107480 | A1* | 5/2012 | Gane | C08L 33/08 426/573 |
| 2014/0370179 | A1* | 12/2014 | Gane | C08L 67/00 426/573 |
| 2014/0371172 | A1* | 12/2014 | Gane | D21C 9/007 162/168.3 |

FOREIGN PATENT DOCUMENTS

| | | | |
|---|---|---|---|
| WO | 95/27825 | A1 | 10/1995 |
| WO | 2010112519 | A1 | 10/2010 |
| WO | 2010115785 | A1 | 10/2010 |
| WO | 2010131016 | A2 | 11/2010 |
| WO | 2014091212 | A1 | 6/2014 |

OTHER PUBLICATIONS

PCT International Search Report and Written Opinion dated Feb. 7, 2018 in corresponding Application No. PCT/EP2017/080831, 10 pages.

* cited by examiner

*Primary Examiner* — Mark Halpern

(74) *Attorney, Agent, or Firm* — Dilworth IP, LLC

(57) ABSTRACT

A method for preparing a binder composition containing water, plant fibers and mineral fillers, wherein the method comprises:

preparing a suspension of plant fibers and mineral fillers in water, the weight ratio between the plant fibers and the mineral fillers being comprised between 99/1 and 2/98, refining this suspension, and obtaining a binder composition wherein the refined fibers have a mean size of between 10 and 700 μm, and wherein the refined fibers, at least partially, embed the refined mineral fillers, wherein refining is carried out in the absence of any grinding medium made of ceramic or metal.

20 Claims, 1 Drawing Sheet

BINDER COMPOSITION BASED ON PLANT FIBERS AND MINERAL FILLERS, PREPARATION AND USE THEREOF

FIELD OF THE INVENTION

The present invention relates to a binder composition whose components may come primarily from mixtures of recycled materials and/or industrial waste, or even any paper stream rich in mineral fillers and cellulose fines/fibers. This binder composition is primarily made up of mineral fillers and plant-based organic materials. This mixture will be qualified hereinafter as "binder composition".

The usage field of the present invention relates to the production of bio-materials, composite products as well as products from the paper industry. It may in particular involve producing paper or cardboard.

DESCRIPTION OF THE PRIOR ART

Paper products, such as paper and cardboard, are prepared from aqueous suspensions of lignocellulosic fibers. They may be prepared from recycled fibers.

Aside from lignocellulosic fibers, these products generally comprise mineral fillers. These fillers may also come from recycling channels, in particular recycled paper pulps.

So-called "recycled" mineral fillers and so-called "natural" (not recycled) mineral fillers are introduced into circuits so as to modify the properties of the paper or cardboard, in particular the optical and/or surface properties. The fillers also make it possible to reduce the cost of the finished product.

As an example, the so-called natural mineral fillers commonly used in the paper industry include calcium carbonate, kaolin, titanium dioxide, talc and colloidal silica.

However, even though in terms of optical or surface properties, natural mineral fillers provide the desired properties, recycled mineral fillers often cause changed and sometimes unwanted optical effects. Nevertheless, irrespective of their origin, all so-called natural or recycled fillers decrease the cost of the paper or cardboard and affect the mechanical and optical properties of the paper or cardboard. Furthermore, in light of the lack of chemical affinity between the mineral fillers and the lignocellulosic fibers, their deliberate or uncontrolled introduction, and depending on their introduction mode, generally requires the presence of other fixing and/or retention agents such as cationic polyacrylamides, and/or binding agents, for example starch used both to improve the strength of the sheet and the retention of the fillers.

Acrylamide-based polymers and their derivatives have also been developed in order to improve filler retention while maintaining the mechanical properties of the paper or cardboard, such as the tear strength, the internal cohesion and the burst strength for example.

Although these solutions are relatively satisfactory, there is nevertheless still a need for alternatives, more particularly an alternative to the polymers and/or starch, for use in the bulk or on the surface in order to improve the physical characteristics of the paper, at a lower cost.

This is the problem broadly speaking that the present invention resolves through the development of a binder composition. This binder composition makes it possible to partially or completely replace the use of strengthening agents in the dry state (starches, amphoteric polyacrylamides, carboxymethylcellulose and guar gums). It also makes it possible to improve the retention and the mineral filler levels while minimizing the losses of mechanical properties of the paper or cardboard.

DISCLOSURE OF THE INVENTION

The present invention relates to a binder composition primarily made up of water, plant-based organic materials and mineral fillers.

More specifically, the present invention relates to a binder composition containing water, plant fibers and mineral fillers,

- the weight ratio between the plant fibers and the mineral fillers being comprised between 99/1 and 2/98, advantageously between 95/5 and 15/85, more advantageously between 80/20 and 20/80,
- the plant fibers and the mineral fillers having been refined simultaneously.

The present invention also relates to a method for producing this binder composition and its use in the production of paper or cardboard.

Binder Composition:

The binding properties of the binder composition result from its preparation, and more particularly the refining of plant-based organic materials (plant fibers) in the presence of mineral fillers. The refining corresponds to a mechanical compression and shearing treatment. In general, refining allows the fibrillation and/or cutting of the plant-based organic materials. Refining further allows the development of the specific surface area and the binding power of the plant fibers.

The presence of mineral fillers during refining makes it possible to fragment the latter, but also to coat them at least partially with the plant fibers that have been refined. Thus, in the binder composition according to the invention, the mineral fillers are at least partially bonded to one another owing to the formation of a network between the plant fibers that have been refined.

Once coated, the mineral fillers of the binder composition can be fixed and/or included in a network of lignocellulosic fibers to produce paper or cardboard. Their integration in this type of fibrous network with a large specific surface area makes it possible to improve the mechanical properties and/or the softness of the paper or cardboard, while adding mineral fillers through the standard methods deteriorates the mechanical characteristics and/or the softness. By "coated mineral fillers" in the binding composition, we mean mineral fillers that are at least partially embedded within the fibers, preferably totally embedded. The mineral fillers are therefore at least partially covered or surrounded by the fibers.

One of the specificities of the binder composition is related to the increase in the level of mineral fillers without altering the physical characteristics of the paper or cardboard. Indeed, at least some of the mineral fillers present in the paper or cardboard comes from the binder composition, in which the mineral fillers are at least partially coated by the plant fibers. Increasing the specific surface area of the plant fibers makes it possible not only to fix the mineral fillers present during refining, but also to improve the retention of the mineral fillers in a process for producing paper or cardboard. Consequently, a binder composition refers to a composition which fixes mineral fillers without harming the mechanical characteristics of the paper or cardboard.

The plant fibers are generally lignocellulosic fibers. They may be obtained from cellulose fibers derived from lignocellulosic materials, in particular wood (hardwood or softwood) and annual plants. They may also come from recycling cellulosic materials.

The plant fibers of the binder composition have a mean size advantageously comprised between 10 μm and 700 μm on average. The size of the fibers is more advantageously between 10 μm and 500 μm on average, even more advantageously about 10 μm to 400 μm, and even more advantageously about 100 μm to 400 μm. This is the mean size of the fibers having been refined in the presence of mineral fillers. According to another embodiment, the plant fibers of the binder composition may have a mean size advantageously comprised between 10 μm and 600 μm, more advantageously about 100 μm to 600 μm. In general, fibers having a size of from 10 μm to 80 μm are called fines.

Size refers to the largest dimension of the plant fibers, for example the length.

Typically, properties such as size (length, diameter, thickness) can be obtained from conventional methods and apparatus, for instance a MorFi Fiber Morphology analyzer.

The binder composition according to the invention is a fibrous composition. It contains refined fibers but it may contain fines (i.e fibers having a size from 10 μm to 80 μm) and/or fibrillated fibers. In general, the refined fibers of the binder composition includes:

- fibers that have been cut, these fibers may be fibrillated or not,
- fines (10-80 μm) i.e. fibers that have been cut or fibrillated fibers that have been cut.

However, the fibrous content of the binder composition is mostly made of refined fibers. Refined fibers include fibers that have been cut and fibrillated fibers. The 99/1 to 2/98 weight ratio of the binder composition relates to refined fibers and refined fillers; it therefore relates to fibers that have been cut and to fibrillated fibers.

According to a specific embodiment, the binder composition may have a fines (fibers having a size of 10-80 μm) total percentage preferably higher than 30% in length, more preferably more than 50%, even more preferably of between 60 and 90%, and even more preferably between 70% and 90%. These percentages can be obtained from conventional methods and apparatus, for instance a MorFi Fiber Morphology analyzer, the % fines in length.

Fibers are composed of layers of microfibrils. More specifically, a fiber is formed by tens or hundreds of microfibrils (generally less than 500 microfibrils) arranged in layers connected by lignin and/or hemicellulose. Refined fibers have a diameter that is generally between 10 and 60 μm, preferably between 15 and 40 μm, and a length that is generally between 10 μm and 700 μm, more preferably between 100 μm and 600 μm.

Fibrillated fibers are fibers having fibrils emerging from a main core of the fibers.

Microfibrils result from the fibrillation of fibers. They are composed of aggregates of fibrils, generally less than 60 fibrils. For instance, WO 2014/091212 and WO 2010/131016 relate to the formation of microfibrils.

Nanofibrils or primary fibrils result from the fibrillation of microfibrils. They are formed of cellulose macromolecules that are associated through hydrogen bonds. For instance, WO 2010/112519 and WO 2010/115785 relate to the formation of nanofibrils.

Typically, nano-crystalline cellulose has a width of about 5 nm to 50 nm and a length of about 100 nm to 500 nm. Nano-fibrillar cellulose has a width of about 20 nm to 50 nm and a length of about 500 nm to 2000 nm. Amorphous nanocellulose (elliptical) has an average diameter of about 50 nm to 300 nm. (see Chamberlain D., Paper Technology Summer 2017 Micro- and Nano-Cellulose Materials—An Overview).

Refining allows cutting the fibers. It also allows the swelling of the fibers. Fibers that have been refined are therefore shorter and swollen. When peeling of the fibers occurs during the refining, the size (diameter or thickness) of the resulting fibers is not drastically reduced since swelling occurs as well. These two phenomena actually cancel each other. However, refining increases the amount of fibers having a size of less than 80 μm.

In summary, refining according to the invention promotes cutting the fibers vs fibrillating the fibers.

The binder composition according to the invention has a percentage of fibers having a mean size of 335 μm or more that is preferably 10% or less of the overall amount of fibers within the binder composition, more preferably between 1% and 10%, and even more preferably between 1% and 5%.

At the end of the refining, the plant fibers have a specific surface area advantageously included between 5 $m^2 \cdot g^{-1}$ and 200 $m^2 \cdot g^{-1}$, more advantageously between 10 $m^2 \cdot g^{-1}$ and 100 $m^2 \cdot g^{-1}$.

The plant fibers implemented are advantageously derived from paper and/or cardboard recycling channels.

In the binder composition, the plant fibers (recycled or not) correspond to the part of the organic material derived from the plant able to be burned when the binder composition, previously dried, is subjected to a temperature at 425° C. for a duration of at least 2 hours. The mass thus burned corresponds to the plant fiber mass part.

Aside from the plant fibers, the binder composition also comprises mineral fillers.

In general, any type of conventional mineral fillers can be implemented in the invention. This may involve natural mineral fillers, i.e., fillers not derived from recycling.

However, the mineral fillers are advantageously derived from paper and/or cardboard recycling channels.

Irrespective of their origin, the mineral fillers can in particular be chosen from the group comprising calcium carbonate, kaolin, titanium dioxide, talc, and mixtures thereof.

In the binder composition, the mineral fillers have a mean size advantageously centered around 1 μm to 100 μm, more advantageously around 10 μm to 50 μm. They may also assume the form of unitary fillers and/or clusters. Typically, the mean size may be centered around 1 μm to 10 μm.

Size refers to the largest dimension, for example the diameter for spherical fillers or clusters. This is the size of the fillers after refining in the presence of plant fibers.

In the binder composition, the mineral fillers, recycled or not, correspond to the part of the mineral material not burned when the binder composition, previously dried, is subjected to a temperature at 425° C. for a duration of at least 2 hours.

In the case of fillers and/or plant fibers derived from recycling, in particular paper or cardboard recycling, the same combustion test at a temperature of 425° C. for at least 2 hours can be used to determine the quantity of plant fillers and the quantity of mineral fillers contained in the recycled materials.

When the mineral fillers and/or plant fibers come from recycling channels, they can be derived from recycled materials and/or industrial plant waste. They may also be derived from de-inking sludge and/or other industrial waste. In general, these compositions are primarily made up of mineral fillers and/or organic matter.

Thus, the binder composition may comprise:

water, natural (not recycled) plant fibers and/or recycled plant fibers, and natural (not recycled) mineral fillers and/or recycled mineral fillers.

The present invention therefore makes it possible to combine plant fibers (recycled and/or not recycled) and mineral fillers (recycled and/or not recycled) in a homogeneous composition.

As already indicated, the binder composition has a plant fibers/mineral fillers weight ratio comprised between 99/1 and 2/98, advantageously between 95/5 and 15/85, advantageously between 80/20 and 20/80. Advantageously, it comprises 5 to 500 g of the mixture of plant fibers and mineral fillers per liter of water, more advantageously 10 g to 100 g, and still more advantageously 20 g to 50 g.

According to one particular embodiment, the binder composition may also comprise at least one additive, for example a rheology modifier, or an agent to improve mechanical characteristics. In the binder composition, the at least one additive advantageously represents between 0 and 50% relative to the weight of the binder composition. When present, this at least one additive amounts to at least a non-zero weight percentage.

However, aside from any impurities, the composition according to the invention is advantageously made up of water, plant fibers (recycled or not) and mineral fillers (recycled or not). Any impurities may in particular come from the fibrous suspension used to prepare the plant fibers of the binder composition. When present, impurities preferably amount to less than 10 wt % of the binder composition, preferably less than 5 wt %, and more preferably less than 1 wt %. The amount of impurities can be measured according to conventional methods, for instance with a Somerville screen having a standard slot width of 0.15 mm. Impurities may include plastics . . . .

The binder composition according to the invention corresponds to a composition with a homogeneous distribution of its components in the volume, the refining making it possible to fragment the mineral fillers and, at least partially, to coat them in the plant fibers.

The binder composition has a Brookfield viscosity that preferably ranges from 500 cps to 20 000 cps, more preferably from 800 cps to 12 000 cps.

The Brookfield viscosity of the binder composition can be measured with a Brookfield viscometer, at 25° C. with an LV module. The skilled person in the art will be able to determine the module and speed (Brookfield viscometer, LV module) adapted to the range of viscosity to measure. The Brookfield viscosity is preferably measured after 100 seconds at 100 rpm.

The binder composition is generally thixotropic. In other words, its viscosity decreases upon shearing and returns to the original viscosity or increases with time when shearing ends.

Method for preparing the binder composition: The present invention also relates to the method for preparing the binder composition.

As already indicated, the properties of the binder composition result from the refining of the plant fibers in the presence of mineral fillers.

This method comprises the following steps:

preparing a suspension of plant fibers and mineral fillers in water, the weight ratio between the plant fibers and the mineral fillers being comprised between 99/1 and 2/98, advantageously between 95/5 and 15/85, more advantageously between 80/20 and 20/80, refining this suspension.

Refining cannot be compared to a grinding process or to a fibrillating process. Applicants have compared a commercially available mixture resulting from the grinding of cellulose and mineral fillers. The different experiments carried out by the Applicants (see the "Examples" section below) show that the binding composition according to the invention affords improved strength properties.

Without wishing to be bound by theory, Applicants consider that these improvements are due to the fact that the refining step enhances cutting the fibers. As opposed to a grinding step, it does not promote fibrillating the fibers although some fibrillating may occur. Additionally, fibrillating according to the invention affords a homogeneous size distribution wherein fibrillating processes such as grinding affords a disparate size distribution. Finally, as opposed to grinding, refining according to the invention affords mineral fillers coated with or embedded within the refined fibers.

Refining affords fibers that have been cut. Refined fibers mostly consist of fibers that have been shortened in terms of length. Refining does not mean fibrillating since it does not aim at splitting up fibers into microfibrils or nanofibrils. However and as already mentioned, some amount of fibrillation may occur. Indeed, minor amounts of fibers may be partially or totally fibrillated. Furthermore, refining may afford swollen fibers (the refining step is carried out in the presence of water).

Refining is generally carried out between two parallel refiner discs having a fixed distance between the discs, generally between a rotating disc and a fixed disc. Refining may also be carried out through a series of parallel pairs of discs, preferably a series of several pairs of discs (2 to 6 pairs of discs for instance) that may have the same inter-discs distance or a decreasing inter-discs distance. For instance, these discs can be made of steel or stainless steel. Typically, refiner discs comprise bars and grooves. The skilled person in the art will be able to select the appropriate discs that will promote cutting over fibrillating the fibers.

Grinding involves shearing/breaking and crushing the fibers. The shearing/breaking in a grinding process is definitely greater than that in a refining process. More specifically, in a grinding process, fibers are exposed to abrasion since they are immobilized and pressed against a grinding medium or a grinding disc (discs with protruding grits). As a result, the fibers are separated into broken individual fibers that are crushed. On the other hand, refining peels and cuts the fibers.

Fibrillating or nanofibrillating affords fibrils i.e. splitting the fibers into fibrils. However, such process does not necessarily involve reducing the length of the fibers. It is therefore opposed to refining. Nanofibrils can be prepared by ultra-fine grinding. Typically, an ultra-fine grinder comprises ceramic discs separated by a distance that depends on the composition fibers fed to the grinder. The distance between the two discs changes during the grinding process.

As a result, fibrillated fibers have generally a length that is greater than that of refined fibers.

Further, according to the invention, refining is preferably carried out in the absence of any grinding medium such as beads, balls or pellets of any hard material such as ceramic or metal.

Prior to the refining, this method may also comprise a fractionating step and/or an enzymatic treatment step. The method may therefore comprise the following sequence:

a) preparation of a suspension of plant fibers and mineral fillers in water, b) optionally, fractionating of this suspension, c) optionally, enzymatic treatment of this suspension, d) refining of this suspension.

a) Preparation of a Suspension of Plant Fibers and Mineral Fillers in Water

The suspension of plant fibers and mineral fillers in water according to the invention can be prepared from recycled or non-recycled plant fibers and recycled or non-recycled mineral fillers. It may therefore result at least partially from recycled materials, for example materials derived from paper or cardboard recycling.

Based on the nature of the recycled materials, non-recycled plant fibers and/or non-recycled mineral fillers can be added to reach the desired plant fibers/mineral fillers weight ratio.

As previously indicated, the plant fibers and/or the mineral fillers may come from recycled materials and/or industrial plant waste. As an example, they may come from papermaking sludge, in particular de-inking sludge or sewage sludge, and/or other industrial waste, and/or a filter cake from white water from a paper machine.

In general, the suspension of plant fibers (fibrous suspension) generally comprises 5 g to 500 g of components of the binder composition per liter of water, more advantageously 10 g to 100 g, and still more advantageously 20 g to 50 g.

The recycled materials are generally subjected to pretreatments making it possible to isolate, during recycling processes, fractions enriched with recycled mineral fillers and plant fibers having a mean size generally smaller than 2000 μm.

Consequently, in the aqueous suspension, the plant fibers have a mean size advantageously smaller than 5000 μm, more advantageously smaller than 2000 μm, more advantageously smaller than 1000 μm, and still more advantageously smaller than 800 μm.

Any addition of mineral fillers may be done before and/or after the fractionating step. It may also be done before and/or after the enzymatic processing step. Thus, the optional steps (fractionating and enzymatic treatment) can be done in the absence of mineral fillers. Only the refining step is necessarily done in the presence of plant fibers and mineral fillers.

b) Optional Fractionating

The fractionating step is optionally done before the refining, and if applicable before an enzymatic treatment.

The fractionating of the suspension of plant fibers makes it possible to enrich the suspension with short plant fibers having a mean size advantageously smaller than 2000 μm, more advantageously smaller than 1000 μm, and still more advantageously smaller than 800 μm. If applicable, i.e., when the suspension of fibers comprises mineral fillers, the fractionating can also enrich the suspension with mineral fillers.

Thus, compared to a suspension of fibers not enriched by fractionating, the suspension enriched with short plant fibers and/or mineral fillers makes it possible to facilitate the coating of the mineral fillers and, consequently, the production of the binder composition with less energy.

The fractionating can be done using conventional techniques, in particular by screening with slots and/or holes and/or hydrocyclone and/or thickener-washer.

At the end of the fractionating, mineral fillers may optionally be added to the suspension of plant fibers. Non-fractionated plant fibers may also be added, these plant fibers having a mean size advantageously smaller than 5000 μm.

c) Optional Enzymatic Treatment

According to one particular embodiment, the plant fibers may undergo an enzymatic treatment prior to the refining step.

This treatment is advantageously done after a fractionating step.

Thus, according to one preferred embodiment, the method for preparing the binder composition comprises the following steps:

fractionating a suspension of recycled or non-recycled fibers that may also comprise recycled or non-recycled mineral fillers, optionally, adding recycled or non-recycled mineral fillers and/or industrial waste to the suspension resulting from the fractionating, enzymatic treatment of this suspension, optionally, adding recycled or non-recycled mineral fillers and/or industrial waste to this suspension, refining this suspension of plant fibers and mineral fillers.

The enzymatic treatment can be done with or without the presence of mineral fillers. Indeed, mineral fillers may be introduced prior to the enzymatic treatment, or between the enzymatic treatment and the refining.

The enzymatic treatment is advantageously done in the presence of a mixture of enzymes, and prior to the refining.

These enzymes are able to break down at least one of the components of the plant fibers, i.e., the lignin and/or the cellulose and/or the hemicellulose. In general, these enzymes may make the plant fibers fragile by altering their components.

The person skilled in the art will know how to choose the appropriate enzymes as well as the treatment conditions based on the latter.

The activity of the enzyme may be stopped by exposing the suspension to steam.

At the end of the enzymatic treatment, mineral fillers may optionally be added to the suspension of plant fibers. Plant fibers that have not been enzymatically treated may also be added.

d) Refining of the Plant Fibers in the Presence of Mineral Fillers

As already indicated, the refining of the plant fibers is done in the presence of mineral fillers. It makes it possible to develop the specific surface area of the plant fibers and to at least partially coat the mineral fillers with the plant fibers.

Advantageously, the refining does not alter the concentration of the suspension in terms of plant fibers and mineral fillers. The quantity of each of the components of the binder composition is therefore advantageously determined just before performing the refining.

The refining is advantageously done after a fractionating step and/or an enzymatic treatment step.

Before refining, the mineral fillers generally have the form of clumps of fillers. Furthermore, the clumps of mineral fillers derived from recycling generally have a size, for the coarsest, ranging from 400 μm to 1000 μm, which is incompatible with immediate use to produce paper without negative consequences.

In general, refining a fibrous suspension makes it possible to compress and shear the plant fibers. In the present case, the refining also makes it possible to decrease the size of the mineral fillers, in particular by breaking up aggregates of mineral fillers. The simultaneous refining of the fibers and fillers also serves to coat, or embed, the fillers at least partially by the fibers over the course of the process for producing the binder composition.

Refining making it possible to fragment the mineral fillers (or aggregates), at the end of the refining, the recycled mineral fillers (or the clumps) have generally experienced an increase by a factor of at least 1.5 to 30 relative to their initial specific surface area, preferably at least 5 and possibly approximately 10. In other words, the refining increases the specific surface area of the recycled mineral fillers.

The mineral fillers, refined and at least partially coated with the plant fibers, then have a mean size advantageously centered around 1 μm to 100 μm, more advantageously around 10 μm to 50 μm. Typically, the mean size may be centered around 1 μm to 10 μm. They may also assume the form of unitary fillers and/or clusters of unitary fillers.

Size refers to the largest dimension of the fillers or clumps after the refining step, for example the diameter for spherical fillers or clumps.

Thus, this method is particularly suitable for using products derived from paper or cardboard recycling, which until now could be deemed undesirable due to the potential presence of mineral fillers and fine cellulose elements.

As already mentioned, at the end of refining, the refined fibers have a length-weighted average length advantageously comprised between 10 μm and 700 μm, more advantageously between 10 μm and 500 μm, even more advantageously about 100 μm to 400 μm. According to another embodiment, the plant fibers of the binder composition may have a mean size advantageously comprised between 100 μm and 600 μm, more advantageously about 100 μm to 600 μm. In general, fibers having a size of from 10 μm to 80 μm are called fines.

According to the average knowledge of a skilled person in the art, the mean length weighted length is preferably obtained from the following formula in which "n" is an individual fiber and "1" is the length of an individual fiber:

$$\frac{\sum n.l^2}{\sum n.l}.$$

Furthermore, at the end of the refining stage, the binder composition has a concentration having a dry content (plant fibers+mineral fillers) advantageously comprised between 5 and 500 g per liter of water, more advantageously about 10 to 100 g per liter of water, and still more advantageously 20 g to 50 g per liter of water.

As already mentioned, refining is generally carried out between parallel refiner discs having a fixed distance between the discs. According to a preferred embodiment of the invention, the aqueous suspension of plant fibers and mineral fillers to be refined is preferably passed between these discs once or several times. The refining is usually stopped after 10 to 80 passages through the refiner discs, more preferably 10 to 60 passages, even more preferably after 15 to 40 passages.

The method according to the invention has an overall energy input of between 200 and 2000 kW·h per ton of plant fibers and mineral fillers, more preferably between 300 and 900 kW·h per ton, even more preferably between 400 and 700 kW·h per ton.

According to the invention, refining preferably means running the aqueous suspension of plant fibers and mineral fillers to be refined between refiner discs, for instance between two refiner discs. Running the suspension indefinitely is not necessary as refining reaches a threshold. Furthermore, over refining does not occur as most of the fibers are preferably never fibrillated.

After the refining stage, the binding composition may be concentrated, for instance water may be partially evaporated.

Use of the Binder Composition:

The present invention also relates to the use of the binder composition in a method for producing paper or cardboard, as well as a method for producing paper or cardboard.

This binder composition is for example usable in a method for producing paper and/or cardboard, and/or producing biomaterials and/or composites. Indeed, it makes it possible to improve the cohesion between the plant fibers, fix the mineral fillers in the finished product, and participate in improving the mechanical properties.

When the binder composition is used as an additive in a conventional process for producing paper or cardboard, it is advantageously introduced into the diluted paste, for example in the headbox, and/or in a stratified headbox. The quantity of binder composition introduced then advantageously represents 0.5 to 10% by weight relative to the mass of the suspension of fibers.

The binder composition can also be applied on paper or cardboard that has already been formed. It then involves a surface treatment in which the binder composition is advantageously applied via spray bars and/or surface application, for example in coating or size press.

This binder composition makes it possible to contribute to the mechanical properties of internal cohesion, tensile, burst, compression resistance, etc. and/or softness and/or decreased permeability and/or better filler retention, without hindering the drainability process during forming of the paper or cardboard.

In light of its properties, the binder composition according to the invention can be used to prepare any type of paper or cardboard. It can thus be introduced into a specific layer of a laminate (laminating process for heterogeneous layers).

It can also be used to increase the quantity of mineral fillers in printing and writing papers and/or sanitary or household papers (paper towels, tissues, toilet paper, napkins, etc.).

The invention and its advantages will become more apparent to one skilled in the art from the following figures and examples.

EXAMPLES

The binding composition according to the invention (GP) has been compared to a composition resulting from the grinding of fibers in the presence of mineral fillers (CE).

1/ Preparation of the Composition According to the Invention

Plant fibers are treated as follows in the presence of mineral fillers:

- Preparation of a paper pulp (Helico pulper): 160 kg plant fibers+1300 liter of water at 63° C. for 15 minutes,
- Enzymatic treatment in a bioreactor:
  - 30 minutes at 50° C.,
  - Filtering (Buchner) (% C retention=4.96%),
- Refining (16 inches) for 180 minutes, with an overall specific energy of 600 kWh per ton of fibers and fillers.

Table 1 summarizes the different treatments carried out in order to prepare the GP0, GP2 and GP3 compositions (softwood+$CaCO_3$ simultaneously refined).

TABLE 1

Conditions for preparing the composition according to the invention (GP0, GP2, GP3).

| Composition | Pulper | Enzymatic treatment | % C | Refining |
|---|---|---|---|---|
| GP0 | Industrial | 30 minutes at 50° C. | 4,96% | 180 minutes |
| GP2 | Lab | 30 minutes at 50° C. | 2% | 190 minutes |
| GP3 | Lab | 30 minutes at 50° C. | 2% | 120 minutes |

GP0, GP2 and GP3 have a mineral filler of 2.00; 18.60 and 45.40 wt % respectively, with respect to the dry weight of the GP compositions. The amount of mineral fillers corresponds to the ash content after treatment of the composition at 425° C.

2/ Counter-Example (CE)

The composition according to the invention has been compared to a composition (CE) comprising fibers and mineral fillers that have been simultaneously grinded.

The CE composition comprises softwood fibers and $CaCO_3$ mineral fillers. It has an ash content of 53.6 wt % at 425° C.

3/ Properties of the GP Compositions Vs CE

The size distribution of the GP compositions (refining) has been compared to the CE composition resulting from a grinding process.

These analyses have been carried out with a MorFi instrument (Techpap). Only fibers and fillers having a size of at least 80 μm have been considered.

Figure 1:
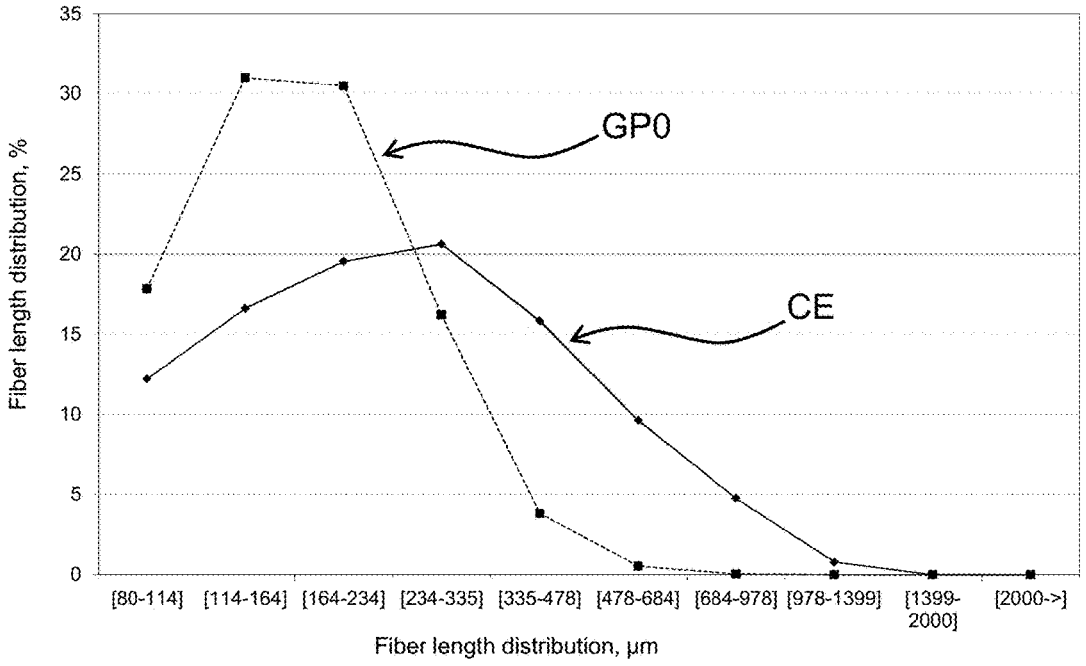
FIG. 1 shows the fiber length distribution of the binding composition according to the invention vs a composition obtained by grinding (area weighted fiber length).

According to FIG. 1 (area weighted fiber length), the GP0 composition has a narrow size distribution centered at about 174 μm. Less than 15% of the fibers of GP0 have a size of 335 μm or more.

The composition according to counter-example CE has 30% of its fibers of 335 μm or more. The size distribution of the GP composition is therefore definitely more homogeneous than that of the CE composition, as also demonstrated by the various length measurements (see FIG. 2).

Figure 2:
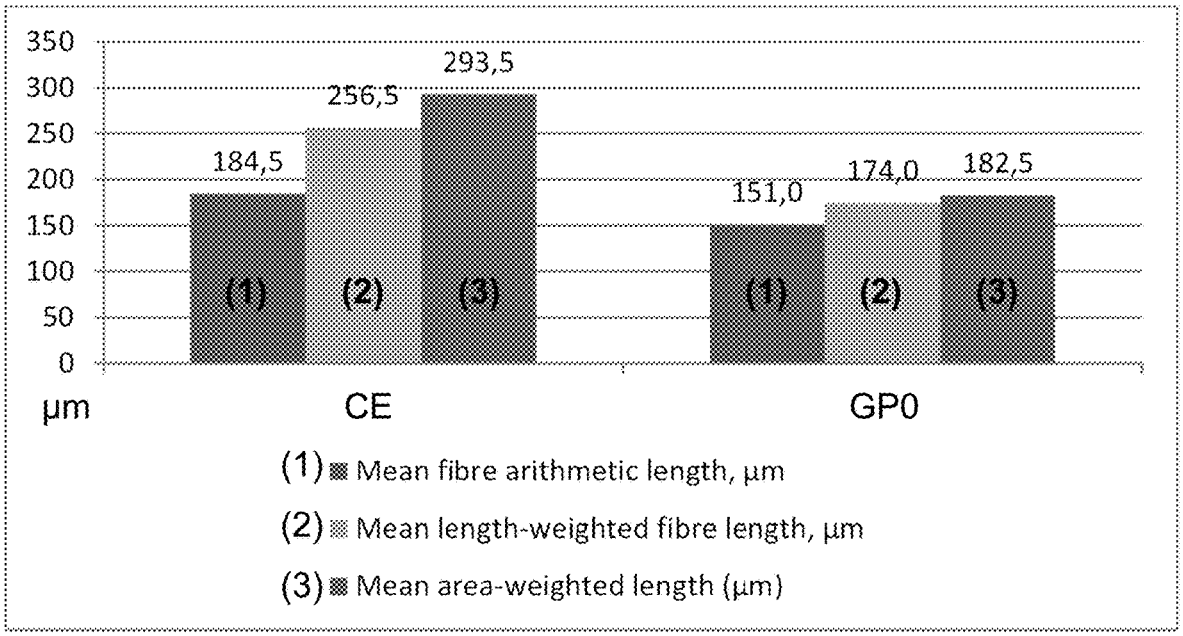
FIG. 2 shows mean fiber lengths of the binding composition according to the invention vs a composition obtained by grinding.

FIG. 2 shows indeed mean fiber lengths of the binding composition according to the invention vs a composition obtained by grinding. The mean fiber arithmetic length (L(n)), the mean length-weighted fiber length (L(l)) and the mean area-weighted length (L(w)) are respectively calculated according to the following formula:

$$L(n) = \frac{\sum_i n_i l_i}{\sum_i n_i} \quad L(l) = \frac{\sum_i n_i l_i^2}{\sum_i n_i l_i} \quad L(w) = \frac{\sum_i n_i l_i^3}{\sum_i n_i l_i^2}$$

4/ Papermaking Involving the Compositions According to the Invention and the CE Composition Paper sheets (90 g/$m^2$) have been formed with a dynamic sheet former. 5 wt % (dry weight) of a GP or CE composition (see "Added composition" line in Table 2) have been added to a paper pulp containing plant fibers (softwood) that have been refined at 25° SR (see "Initial pulp" line in Table 2).

Additional mineral fillers have been added as shown in Table 2 so as to reach a total of 15 wt % (see "Added $CaCO_3$" and "Total $CaCO_3$" lines in Table 2).

TABLE 2

Paper pulp compositions-Properties

| | | CE | GP0 | GP2 | GP3 |
|---|---|---|---|---|---|
| Added composition | Fibers (wt %) | 2.68 | 0.10 | 0.93 | 2.27 |
| | Fillers (wt %) | 2.32 | 4.90 | 4.07 | 2.73 |
| Initial pulp | Added $CaCO_3$ (wt %) | 12.32 | 14.90 | 14.07 | 12.73 |
| | Softwood fibers (wt %, 25° SR) | 82.68 | 80.10 | 80.93 | 82.27 |
| Final pulp | Total $CaCO_3$ (wt %) | 15.00 | 15.00 | 15.00 | 15.00 |
| | Total softwood fibers (wt %) | 85.00 | 85.00 | 85.00 | 85.00 |
| | Ash content in the formed sheet (425° C.), wt % | 5.10 | 6.70 | 11.90 | 11.60 |
| | Ash retention, wt % | 34.00 | 44.67 | 79.33 | 77.33 |
| | Bulk, $cm^3/g$ | 1.51 | 1.44 | 1.46 | 1.49 |
| | Tensile index, N*m/g | 60.5 | 65.3 | 55.3 | 54.2 |
| | TEA, $N.m/mm^2$ | 0.215 | 0.263 | 0.244 | 0.245 |
| | Burst index, $kPa.m^2/g$ | 6.30 | 6.70 | 5.75 | 5.66 |
| | Scott bond, $J/m^2$ | 385.9 | 490.4 | 409.1 | 369.2 |
| | Air permeability, $cm^3/m^2.Pa.s$ | 6.2 | 2.2 | 2.8 | 3.1 |
| | Opacity, % | 84.5 | 85.3 | 90.0 | 89.2 |

The sheets of paper made from GP compositions have a greater filler retention than the CE composition (see "Ash retention" line). Refined fibers that embed refined fillers (GP2 and GP3 composition) also promote the retention of added fillers.

The filler content ranges from 5.1 (CE) to 11.9% (GP2). As shown by examples CE and GP0 (similar ash content), the amount of mineral fillers can drastically change the properties of the sheet of paper. Indeed, GP0 affords an improvement of 8% of the Tensile index (65.3 vs 60.5), an improvement of 22% of the TEA (Tensile Energy Absorption; 0.263 vs 0.215), and an improvement of 27% of the Scott bond (bond strength, 490.4 vs 385.9).

In view of the above, the composition according to the invention clearly affords improved properties as compared to prior art compositions resulting from the grinding of plant fibers in the presence of mineral fillers. It also improves the filler retention.

The invention claimed is:

1. A method for preparing a binder composition containing water, plant fibers and mineral fillers, wherein the method comprises the following steps:

preparing a suspension of plant fibers and mineral fillers in water, the weight ratio between the plant fibers and the mineral fillers being comprised between 99/1 and 2/98, refining this suspension, obtaining a binder composition wherein the refined fibers have a mean size of between 10 and 700 μm, and wherein the refined fibers, at least partially, embed the refined mineral fillers, wherein refining is carried out in the absence of any grinding medium made of ceramic or metal.

2. The method of claim 1, wherein refining is carried out between parallel refiner discs.

3. The method of claim 1, wherein refining is carried out between parallel discs, and stopped after 10 to 80 passes.

4. The method of claim 1, wherein fibers are enzymatically treated before refining the suspension.

5. The method of claim 1, wherein after refining, the binder composition has a concentration of plant fibers and mineral fillers of between 5 and 500 g per liter of water.

6. The method of claim 1, wherein the method further comprises after preparation of the suspension of plant fibers and mineral fillers in water and before refining the suspension a fractionating step and an enzymatic treatment.

7. A method for preparing a composition a binder composition containing water, plant fibers and mineral fillers, wherein the method comprises the following steps:

preparing a suspension of plant fibers and mineral fillers in water, the weight ratio between the plant fibers and the mineral fillers being comprised between 99/1 and 2/98, refining this suspension, obtaining a binder composition wherein the refined fibers have a mean size of between 10 and 700 μm, and wherein the refined fibers, at least partially, embed the refined mineral fillers, wherein fibers are enzymatically treated before refining the suspension, wherein, refining is carried out between parallel discs, and stopped after 10 to 80 passes between parallel discs.

8. The method of claim 7, wherein refining is carried out through 2 to 6 pairs of discs.

9. The method of claim 7, wherein refining is carried out through parallel pairs of discs having a same inter-discs gap.

10. The method of claim 9, wherein refining is carried out through parallel pairs of discs, wherein the inter-discs gap decreases over the 10 to 80 passes.

11. The method of claim 7, wherein after refining, the binder composition has a concentration of plant fibers and mineral fillers, of between 5 and 500 g per liter of water, and wherein refining is carried out in the absence of any grinding medium made of ceramic or metal.

12. The method of claim 7, wherein a fractionating step of the fibers is carried out before the enzymatic treatment of the fibers.

13. A method for preparing a composition a binder composition containing water, plant fibers and mineral fillers, wherein the method comprises the following steps:

preparing a suspension of plant fibers and mineral fillers in water, the weight ratio between the plant fibers and the mineral fillers being comprised between 99/1 and 2/98, refining this suspension, obtaining a binder composition wherein the refined fibers have a mean size of between 10 and 700 μm, and wherein the refined fibers, at least partially, embed the refined mineral fillers, wherein fibers are enzymatically treated before refining the suspension, wherein, refining is carried out between parallel refiner discs, in the absence of any grinding medium made of ceramic or metal, wherein, after the refining step, water is partially evaporated to concentrate the binder composition.

14. The method of claim 13, wherein the binder composition has a concentration of plant fibers and mineral fillers, of from 5 to 500 g per liter of water.

15. The method of claim 14, wherein the concentration of plant fibers and mineral fillers in the binder composition is from 10 to 100 g per liter of water.

16. The method of claim 15, wherein the concentration of plant fibers and mineral fillers in the binder composition is from 20 g to 50 g per liter of water.

17. The method of claim 13, wherein refining is carried out through a series of 2 to 6 pairs of discs.

18. The method of claim 13, wherein refining is carried out through a series of parallel pairs of discs having a same inter-discs gap.

19. The method of claim 13, wherein refining is carried out through a series of parallel pairs of discs, wherein the inter-discs gap decreases over the passes between the parallel pairs of discs.

20. The method of claim 13, wherein a fractionating step of the fibers is carried out before the enzymatic treatment of the fibers.

* * * * *